United States Patent [19]

Engel et al.

[11] Patent Number: 4,554,899

[45] Date of Patent: Nov. 26, 1985

[54] SPEED GOVERNING SYSTEM FOR AN INTERNAL COMBUSTION ENGINE WITH SELF-IGNITION

[75] Inventors: Gerhard Engel, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 632,552

[22] Filed: Jul. 19, 1984

[30] Foreign Application Priority Data

Aug. 18, 1983 [DE] Fed. Rep. of Germany ..... 3329800

[51] Int. Cl.[4] ..... F02M 39/00

[52] U.S. Cl. ..... 123/357; 123/339; 123/179 L

[58] Field of Search ..... 123/357, 358, 359, 339, 123/179 L

[56] References Cited

U.S. PATENT DOCUMENTS

| | | | |
|---|---|---|---|
| 3,407,793 | 10/1968 | Lang | 123/358 |
| 3,777,174 | 12/1973 | Butscher | 123/359 |
| 3,965,877 | 6/1976 | Adey | 123/357 |
| 4,321,901 | 3/1982 | Kobayashi | 123/357 |
| 4,357,920 | 11/1982 | Stumpp | 123/358 |
| 4,401,076 | 8/1983 | Sano | 123/357 |
| 4,428,341 | 1/1984 | Hassler | 123/359 |
| 4,441,471 | 4/1984 | Kratt | 123/339 |
| 4,459,955 | 7/1984 | Adey | 123/357 |
| 4,467,762 | 8/1984 | Fischer | 123/359 |
| 4,474,154 | 10/1984 | Henning | 123/339 |

*Primary Examiner*—Carl Stuart Miller

*Attorney, Agent, or Firm*—Edwin E. Greigg

[57] ABSTRACT

For a speed governing system for an internal combustion engine with self-ignition, which includes an electromagnetic final control element for influencing the injection quantity and a control unit having a governor for controlling the final control element, provisions are proposed which give the governor a high dynamic amplification in the range of a drop in the engine rpm, a dynamic amplification that drops from a higher value to a lower value in the range of a sudden drop of engine speed, that is, an rpm undercutting, and a flattened governor characteristic in the vicinity of the ends of the control range. A governor of this kind reacts very flexibly to changes in rpm and in particular does not enter a saturated state, and it adjusts to a new control state without disruptive reacceleration phenomena. A governor of this kind is particularly well suited for motor vehicles having a Diesel engine with a relatively large number of cylinders.

16 Claims, 7 Drawing Figures

SPEED GOVERNING SYSTEM FOR AN INTERNAL COMBUSTION ENGINE WITH SELF-IGNITION

BACKGROUND OF THE INVENTION

The invention is based on a speed governing system for an internal combustion engine with self-ignition as generally defined hereinafter. A system of this kind is known from German laid-open patent application DE-OS No. 31 30 080, which relates to a Diesel idling governor.

Diesel engines have a number of properties that differ from those of gasoline engines. Vehicles with Diesel engines therefore perform differently in some respects as compared with vehicles having carburetor or injection engines. For instance, if the driver suddenly lets up on the accelerator pedal, the speed or rpm of the engine drops relatively rapidly. The effect of this sudden let up on the pedal is an abrupt deceleration of the engine. Letting up on the pedal immediately after cold starting causes an even more severe speed drop. After the pedal has been released, the engine must be regulated to idling with the aid of an idling governor. Diesel engines with a high number of cylinders—six or more—present the associated idling governor with a steep drop in rpm in the case of abrupt deceleration, that is, letting up on the pedal, immediately after cold starting, because of the greater friction in the engine at that time. The danger therefore exists that the engine speed may be undercut to an impermissible extent, speed undercutting, for example, which can cause stalling.

After starting, in the cold phase, misfiring can occur which causes a drop in engine speed. The idling governor reacts to an rpm drop immediately by raising the rpm. A series of misfirings, especially in the cold phase, is therefore capable of causing very rough engine operation.

With the idling governors known previously, an optimal governing quality was not attainable. Known idling governors could not distinguish between the problem of quickly intercepting the engine speed drop in the case of abrupt deceleration, and that of not to misfiring. These two mutually contradictory requirements demanded that a compromise be made, but such a compromise was heretofore unattainable. Because of the parameters involved, the events described above instead lead to overcompensation, especially in the case of misfiring.

OBJECT AND SUMMARY OF THE INVENTION

With the speed governing system according to the invention, as contrasted with the prior art, it is possible to attain a higher governing quality by stabilizing the rpm quickly upon abrupt deceleration, on the one hand, and on the other by a well-damped reacceleration, even in the case of misfiring. To this end, the system according to the invention advantageously operates with a dynamic governor amplifier, which in order to intercept the rpm operates with high amplification but immediately after the interception is damped more and more. A further advantage is the low basic amplification, the value of which is in the range of the mechanical basic governor; in stationary operation, the system is thus substantially non-responsive to misfiring. Finally, it is advantageous that threshold values in the end ranges of the governor characteristic prevent an unnecessary reaction of the governor to irregularities in the rpm.

By means of the provisions recited hereinafter advantageous further embodiments of and improvements to the system disclosed herein are attainable. Instead of the linear D component that was heretofore conventional, the system includes an increased D governor component, which however takes effect only beyond a predeterminable threshold value. The threshold assures that the high dynamic amplification does not take effect immediately in the event of an unsteady course of the rpm signal. The reacceleration in the event of abrupt deceleration can thus be better damped right after the cold start.

Furthermore it is difficult to learn from the gradient of the rpm signal whether an rpm drop was caused by abrupt deceleration or by misfiring, or in other words whether the governor ought to react very fast, or not. In the case of abrupt deceleration, a high amplification must be established, while in the case of misfiring a change in amplification should be damped to the greatest possible extent. The recognition of abrupt deceleration and the associated setting of high amplification is advantageously accomplished by raising the amplification of the governor, from the rpm increase preceding an abrupt deceleration. At the onset of the abrupt deceleration the idling governing is not yet in effect. The amplification of the governor amplifier is controlled to higher values by the output voltage of the rpm evaluation stage. The advantage of a further embodiment of the invention is that upon an rpm drop, that is upon abrupt deceleration of the engine, the amplification then does not recede again equally quickly, but instead is delayed in accordance with a prespecified timing function. The advantage of a still further embodiment of the invention is that the elevation of the amplification factor is effected only above a predetermined threshold value. This prevents an already irregular rpm course, or slight misfiring, from causing roughness in the control loop.

If the output of the governor reaches a limit, because of a large and rapid control deviation, the result is saturation behavior on the part of the governor. In that case the governor is incapable of effecting control back in the opposite direction immediately, and because of the failure of a governor function, marked overcompensation takes place. In accordance with a further advantageous embodiment of the invention, upon the failure of the initial governor voltage to attain a lower limiting threshold the governor is therefore limited by means of a feedback that comes into effect automatically. The governor is now capable of reacting without dead time, because the governor input, corresponding to the PI component, does not first have to move slowly out of the saturated state until reaching the current working point. In an advantageous manner an upper limitation is also introduced, which prevents the governor ouput from returning too late out of the upper limit, or stop. This would otherwise cause pronounced overcompensation. A further advantage is that a transistor is used for the threshold, instead of a fixed diode threshold. This causes the threshold to float. As a result, the I governor is limited and the P amplification is weakened. It is therefore readily possible to take into account that the rpm set-point value or the input of the amplifier be raised to different values.

Finally, in the elevation of the set-point or reference value the raising of the set-point value is advantageously accomplished with a delay. The set-point value is thereby prevented from being raised again and again upon the occurrence of a brief overcompensation. The reacceleration process would otherwise have a rougher course and take longer.

The rpm governing system according to the invention thus includes a governor which during an rpm drop has a high dynamic amplification, which after the interception of the rpm, or after an abrupt deceleration even during the speed undercutting, has a decreasing amplification and which in the static case has only a low basic amplification. Nevertheless all changes in load are compensated for without any problem. It is particularly advantageous that the regulating parameters adapt themselves to changing operating conditions, so that it is unnecessary to introduce additional sensors, such as for the engine temperature, into the system. The nonsensitivity zone created by a threshold value prevents unnecessary response of the control loop to an irregularity of the engine rpm.

The invention will be better understood and further objects and advantages thereof will become more apparent from the ensuing detailed description of preferred embodiments taken in conjunction with the drawings.

DESCRIPTION OF THE PREFERRED EMBODIMENT

Figure 1A:
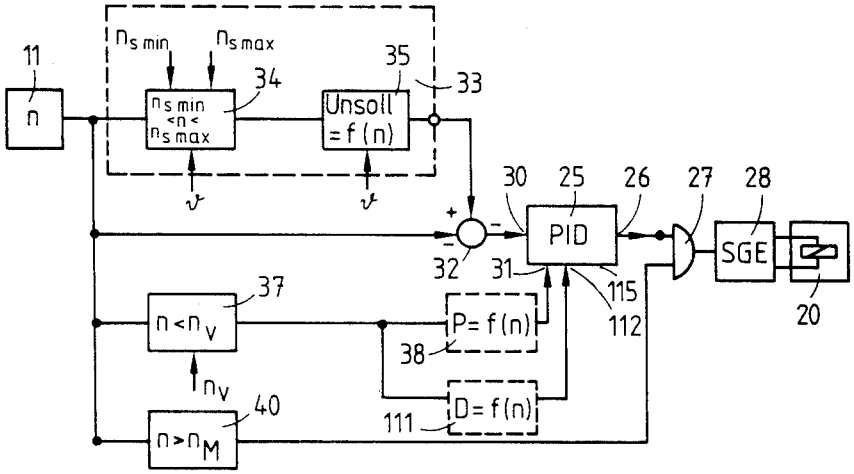
FIG. 1*a*–1*c* each show substantially a different exemplary embodiment of the speed governing system according to the invention.
Figure 1B:
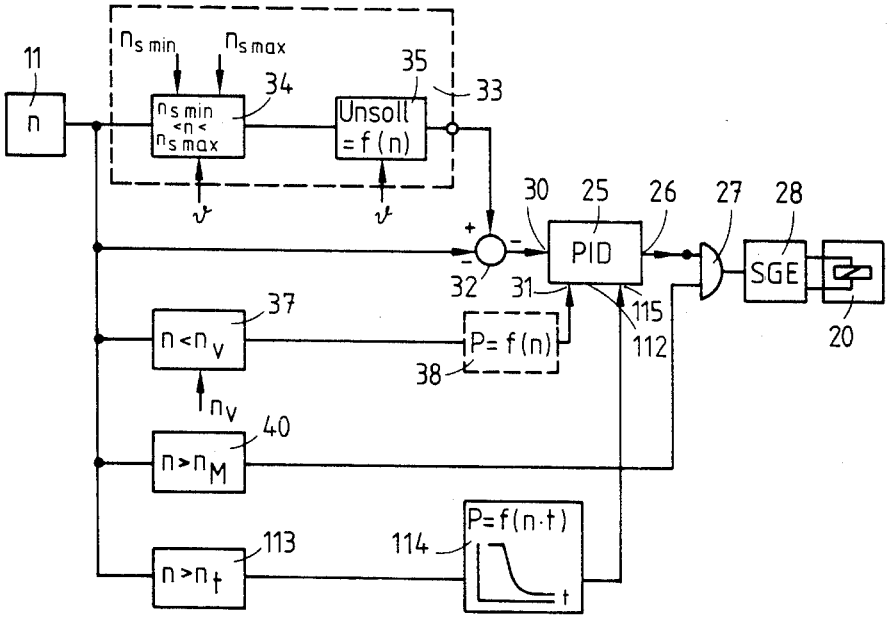
Figure 1C:
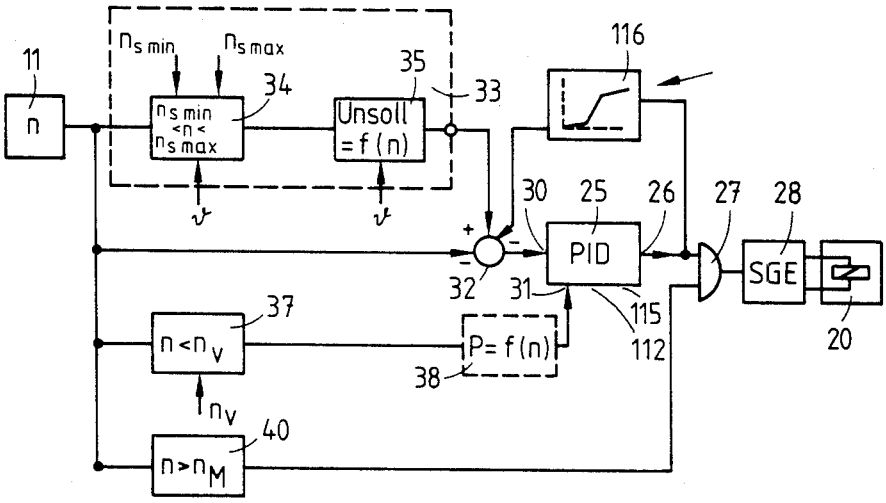

FIGS. 1*a*, 1*b*, and 1*c* in block circuit diagrams, essentially illustrate individual exemplary embodiments of the invention. The German laid open application DE OS No. 31 30 080 mentioned at the outset is incorporated herewith by reference.

In a purely mechanical means of speed governing, a governor rod is adjusted to the position at which the centrifugal force of flyweights and the spring force of an idling spring are in balance. In an electronic idling governing means, such as that on which the invention is based, in addition to the idling spring force the force of an electromagnet in an electromagnetic final control element 20 counteracts the centrifugal force, so that when the magnet is excited the governor rod is additionally adjusted in the direction of an increased fuel quantity. The central element of the disposition according to FIG. 1 is a PID governor amplifier 25, the output 26 of which acts via an AND gate 27 upon a signal end stage 28 and finally upon the exciter winding of the electromagnetic final control element 20. One input 30 of the PID governor amplifier 25 is coupled with a subtraction point 32, to which both rpm signals n from an rpm transducer 11 and the output signal of an rpm set-point or reference value stage 33 are supplied. This rpm set-point or referfence value stage 33 includes an rpm range recognition stage 34 and a set-point value function generator 35. Via a second control input 31 of the PID governor 25, the P component of the governor can be adjusted in accordance with rpm. To this end there is an rpm threshold value switch 37 with a following P-value control stage 38. The PID governor amplifier 25 is thus given a nonlinear P amplification. In the event of large deviations, which occur upon abrupt deceleration of the engine at an overly low engine rpm, a greater P amplification of the governor amplifier thus becomes effective. An ON-switch control stage 40 serves to provide that the electromagnetic final control element, which upon being excited furnishes an increased quantity of fuel, can be switched ON only above a predetermined rpm value. This rpm value is below the working range, in the range of the undercutting.

The rpm governing system further includes, in a first embodiment, as shown in FIG. 1*a*, a differentiating member 111, the input of which is connected with the output of the rpm threshold value switch 37 and the output of which is connected with a further input of the PID governor amplifier 25.

In a second embodiment, according to FIG. 1*b*, an rpm threshold value stage 113 is provided, the input of which is located at the output of the rpm transducer 11. An amplification delay stage 114 is also provided, the input of which is located at the output of the rpm threshold value stage 113 and the output of which is located at a fourth input 115 of the PID governor 25.

In a third embodiment, according to FIG. 1*c*, a limiting stage 116 effective on two sides is added, being located parallel to the feedback of the governor amplifier 25 between the output to the AND gate 27 and the subtraction point 32. The three embodiments listed above will be described in detail below in terms of their function, while the fourth embodiment will be discussed in connection with FIG. 2.

Figure 2:
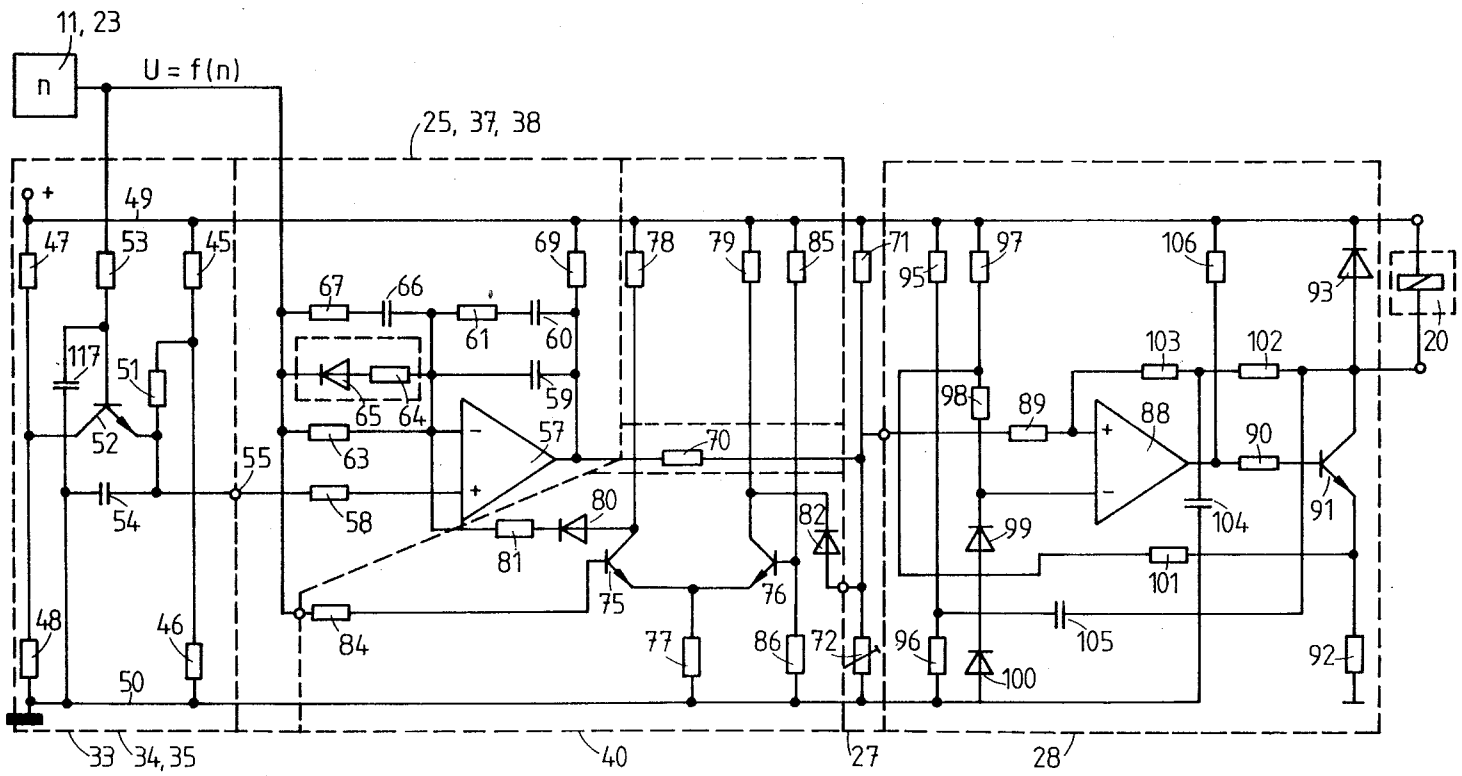
FIG. 2 shows a known governing system in which the principles of the invention are also shown.

FIG. 2 shows the circuit diagram of the known system mentioned at the outset above, in combination with the fourth embodiment of the invention. Following the compensating resistor 53, a capacitor 117 is placed between the base of the emitter follower transistor 52 and ground.

The output voltage at the emitter of the emitter follower 52 intrinsically follows along with the rpm voltage fed in via the compensating resistor 53. With the aid of the capacitor 117, in combination with the compensating resistor 53, an RC element is created, which causes the followup of the set-point value, upon the elevation of the rpm set-point value, in a delayed manner. The set-point value is thus prevented from being repeatedly elevated after brief overcompensations.

Figure 3:
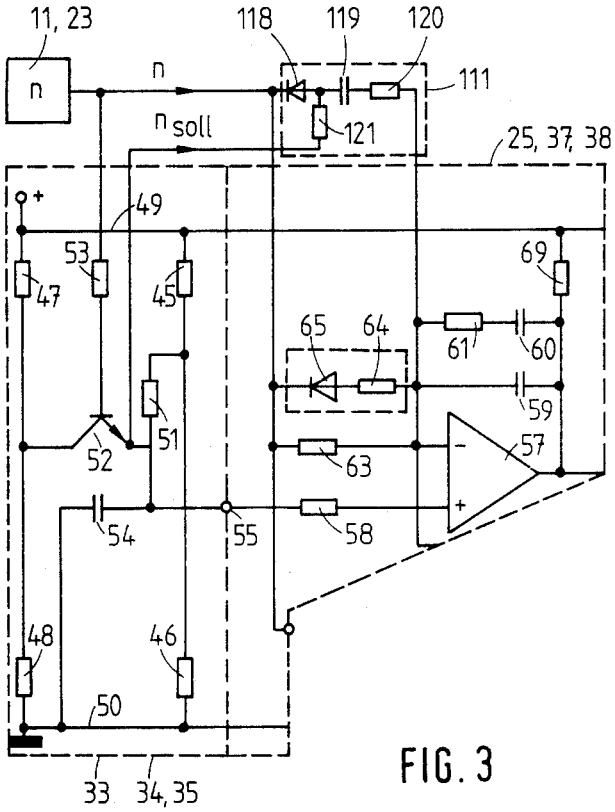
FIG. 3 shows a first embodiment of the invention.

In FIG. 3, essential elements of the first embodiment are shown. The differentiating element 111 includes the series circuit of a diode 118, a capacitor 119 and a resistor 120. The free end of the diode 118 is connected to the rpm transducer 11, and the free end of the resistor 120 is connected to the inverting input of the operational amplifier 57. A resistor 121 is also connected to the junction between the diode 118 and the capacitor 119, its free end being located at the emitter of the emitter follower transistor 52. In comparison with the block circuit diagram of FIG. 2, the resistor 67 and the capacitor 66 are omitted here.

The diode 118 furnishes a threshold value. When the output voltage of the rpm transducer n, that is, the actual rpm, falls below the controlled set-point value from the rpm set-point value control circuit 52 by the amount of the threshold value of the diode voltage, the differentiated rpm signal arrives at the inverting input of the governor amplifier 57. As a result of the omission of the resistor 67 and the capacitor 66, the governor amplifier 57 is initially given an increased D component. Because of the threshold predetermined by the diode 118, this increased D component only becomes effective above this threshold value, however. The high dynamic amplification thus does not already come into effect upon a rough course of the rpm signal, and reacceleration in the event of abrupt deceleration can thus be better damped. A non-sensitive zone is thereby created.

Figure 4:
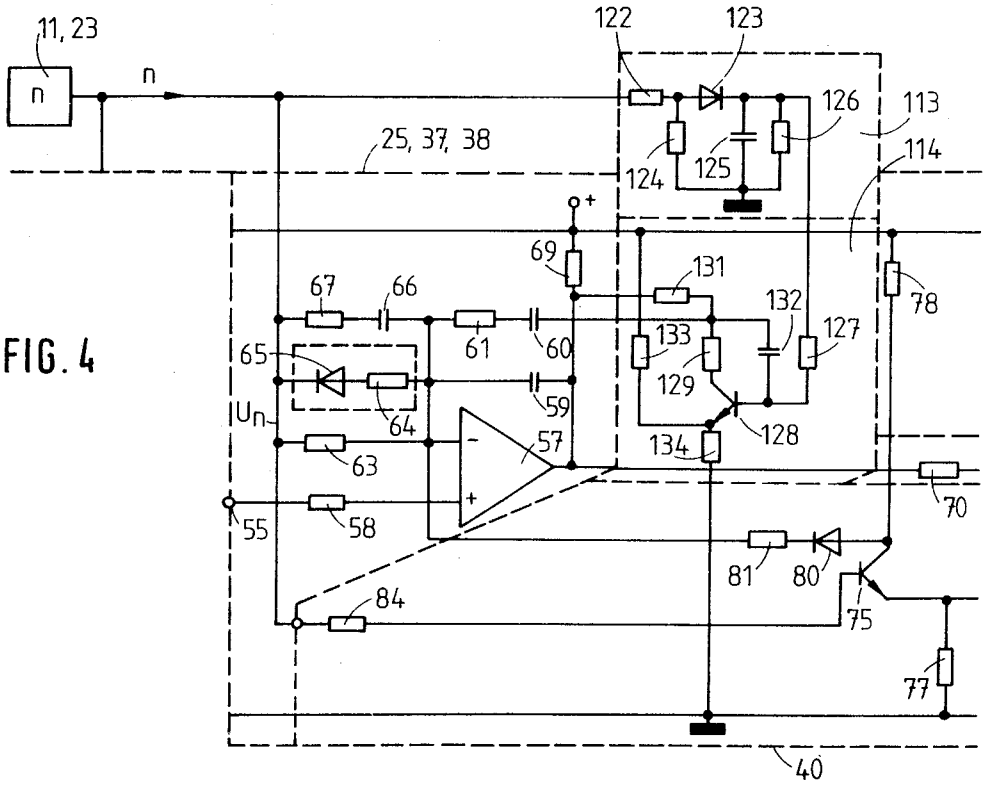
FIG. 4 shows a second embodiment of the invention.

FIG. 4 is an example of circuitry for the second embodiment. The rpm threshold value stage 113 includes an input resistor 122, one end of which is located at the output of the rpm transducer 11, and a diode 123 switched in series with the input resistor 122. Between the junction of these two circuit elements 122, 123 and ground, there is a resistor 124. The parallel circuit comprising a capacitor 125 and a resistor 126 is located between the still free end of the diode 123 and ground. At the same time, the connecting line leads from this connection point of the diode 123 to the amplification delay stage 114. In the course of the connecting line, there is a resistor 127, which is connected to the base of a transistor 128, preferably a field effect transistor. The collector of the transistor 128 is connected via the series circuit comprising two resistors 129, 131 to the output of the operational amplifier 57. The feedback elements located at the inverting input of the operational amplifier, that is, the resistor 61 and the capacitor 60, are now connected with their other ends to the junction of the two working resistors 129, 131. A further capacitor 132 is located between this junction and the base of the transistor 128. The emitter of the transistor 128 is located at the dividing point of a voltage divider comprising resistors 133 and 134, while the voltage divider in turn is located between the positive lead and ground.

For the threshold in the rpm threshhold value stage 113, the threshold voltage of the diode 123 is utilized, which is simple in terms of circuitry. As soon as the output voltage supplied by the rpm transducer 11 exceeds this threshold, then at first the capacitor 132 of the delay member comprising the capacitor 125 and the resistor 126 is charged. Thereafter, however, the amplification of the governor amplifier 57 is rapidly elevated via the transistor 128. The elevation or increasing of the amplification is accomplished by intervening in the voltage divider for the feedback of the operational amplifier 57. When the output voltage of the rpm transducer 11 recedes, the amplification fades relatively slowly, because the capacitor 125 can only discharge slowly via the resistor 126. With these provisions it is attained that an irregular rpm or slight misfiring cannot immediately cause roughness in the control loop, and after the rpm has been intercepted good damping is assured by the fact that the amplification decreases slowly. With a field effect transistor 128, a substantial independence of fluctuations in temperature or voltage can be attained.

Figure 5:
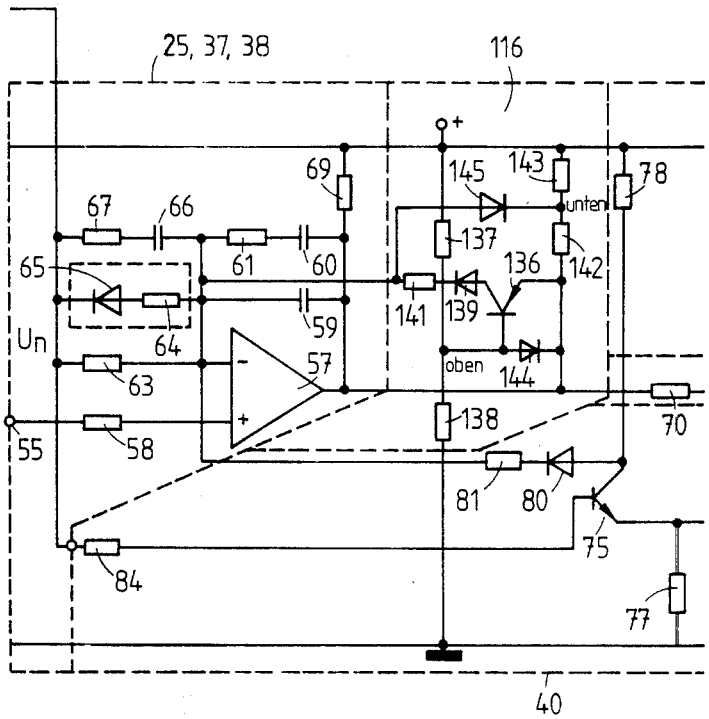
FIG. 5 shows a third embodiment of the invention.

The third embodiment is shown in FIG. 5. The limiting stage 116 effective on two sides includes a transistor 136 for the upper, flatter part of the characteristic curve, the base of which transistor 136 is connected, in order to determine the break in the curve, to a fixed voltage divider having the resistors 137 and 138; this voltage divider 137, 138 is located between the supply voltage source and ground. The collector of the transistor 136 is connected via a diode 139 and a resistor 141 to the inverting input of the governor amplifier 57. The emitter is connected to the output of the governor amplifier 57. A protective diode 144 is located between the emitter and the base of the transistor 136. The break in the curve for the lower limitation is determined by the voltage divider comprising the resistors 142, 143 between the output of the governor amplifier 57 and the supply voltage. Between the junction of the emitter resistors 142, 143 and the inverting input of the governor amplifier 57, there is a further diode 145.

The diodes 139 and 149 represent an antiparallel circuit. The two diodes 139, 145 serve as threshold value transducers. If the governor output voltage falls below a lower limiting threshold, the governor characteristic is limited by the diode 145, by means of the feedback that automatically comes into effect. The governor amplifier 57 can no longer enter the saturated state now; after a renewed increase in the rpm n, it can react without dead time. The upper flattening of the characteristic curve introduced accordingly by the diode 139 and the resistor 141 prevents the governor output from entering a saturated state at a high rpm. The governor output can thus return early, upon a drop in the rpm. By these provisions, an overcompensation at either side of the governor amplifier characteristic curve is prevented. The transistor 136 assures that the diode threshold will float and thus be capable of following along with an increase in the rpm set-point value.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A speed governing electronic system for an internal combustion engine with self-ignition, having an electromagnetic final control element affecting the quantity of fuel to be injected and having a control unit for forming the control signal for said final control element by means of a governor amplifier having PID behavior and further in accordance with the deviation of an actual rpm value from a set-point rpm value, wherein said set-point value which is raised with the rpm, after a threshold has been exceeded, only drops in a delayed manner upon an ensuing abrupt drop in rpm, and wherein upon a drop below a predetermined value dependent on said actual value, a nonlinear elevation of the component of the amplification of said governor amplifier can take place, said governor amplifier having means combining at least one of (1) a means defining a high dynamic amplification behavior in the range of the drop of the engine rpm, and a means defining a flattened characteristic curve in the vicinity of at least one of the ends of the regulated range of said governor amplifier from a threshold value on, and (2) a means defining a dynamic amplification dropping from a higher value to a lower value in the range of an undercutting of an engine drop of rpm caused by cold starting of the engine.

2. A system as defined by claim 1, wherein said governor has a low basic amplification in ranges of stationary engine rpm.

3. A system as defined by claim 1, wherein said governor amplifier comprises a PID amplifier and the elevated D component of said PID amplifier becomes effective only above a predeterminable threshold value for the control deviation.

4. A system as defined by claim 2, wherein a differentiation element is provided, the input of which is connected with an rpm transducer of an evaluation circuit and the output of which is connected with an input of said governor amplifier.

5. A system as defined by claim 1, wherein the amplification of said governor amplifier is elevated upon increasing engine rpm.

6. A system as defined by claim 5, wherein the elevation of the amplification of the governor becomes effective only above a predeterminable threshold of an increase in the engine rpm.

7. A system as defined by claim 5, wherein upon decreasing engine rpm, the amplification of said governor amplifier is retracted in a delayed manner in accordance with a timing function that is fixable in advance.

8. A system as defined by claim 5, wherein there is provided a means for controlling the ratio of a voltage divider, from which the feedback to an inverting input to said governor amplifier branches off, in dependence on an rpm evaluation means in order to elevate the amplification of the said governor amplifier.

9. A system as defined by claim 8, wherein for realizing the threshold in the increasing range of engine rpm, a control stage is triggered by said rpm evaluation means via a diode.

10. A system as defined by claim 9, wherein for effecting the delaying of the drop in the amplification of said governor amplifier, an RC element is connected between said diode and ground.

11. A system as defined by claim 1, wherein said threshold value is embodied in a floating manner in accordance with the magnitude of the elevation of said rpm set-point value.

12. A system as defined by claim 1, wherein the output of said governor amplifier is connected via a diode antiparallel circuit with an inverting input of said governor amplifier for forming said flattened characteristic curve from a threshold value.

13. A system as defined by claim 12, wherein a transistor stage is connected with said diode antiparallel circuit for forming a floating threshold.

14. A system as defined by claim 1, wherein the elevation of the set-point value of the engine rpm takes place in a delayed manner.

15. A system as defined by claim 14, further having an rpm set-point value circuit connected to the output side of an rpm transducer, wherein a capacitor is disposed between the junction of a compensating resistor and the control input of said rpm set-point value circuit and ground.

16. A system as defined by claim 4, wherein the input of said differentiation element is connected to said rpm transducer via a gate circuit.

* * * * *